US009622008B2

(12) United States Patent
Krueger et al.

(10) Patent No.: US 9,622,008 B2
(45) **Date of Patent: *Apr. 11, 2017**

(54) METHOD AND APPARATUS FOR DETERMINING DIRECTIONS OF UNCORRELATED SOUND SOURCES IN A HIGHER ORDER AMBISONICS REPRESENTATION OF A SOUND FIELD

(71) Applicant: Dolby Laboratories Licensing Corporation, San Francisco, CA (US)

(72) Inventors: Alexander Krueger, Hannover (DE); Sven Kordon, Wunstorf (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/766,739

(22) PCT Filed: Feb. 7, 2014

(86) PCT No.: PCT/EP2014/052479

§ 371 (c)(1),
(2) Date: Aug. 7, 2015

(87) PCT Pub. No.: WO2014/122287

PCT Pub. Date: Aug. 14, 2014

(65) Prior Publication Data

US 2015/0373471 A1 Dec. 24, 2015

(30) Foreign Application Priority Data

Feb. 8, 2013 (EP) ..... 13305156

(51) Int. Cl.
*H04R 5/00* (2006.01)
*H04S 3/00* (2006.01)
(Continued)

(52) U.S. Cl.
CPC ..... *H04S 3/00* (2013.01); *G10L 19/008* (2013.01); *G10L 21/0272* (2013.01); *H04S 2420/11* (2013.01)

(58) Field of Classification Search
USPC ..... 381/21, 17, 18, 27
See application file for complete search history.

(56) References Cited

U.S. PATENT DOCUMENTS

2010/0329466 A1* 12/2010 Berge ..... H04R 3/12 381/22
2013/0148812 A1* 6/2013 Corteel ..... H04S 7/30 381/17
2014/0133660 A1* 5/2014 Jax ..... G10L 21/00 381/17
2014/0219456 A1* 8/2014 Morrell ..... H04S 5/00 381/17

FOREIGN PATENT DOCUMENTS

CN 1659926 8/2005
CN 1849844 10/2006
(Continued)

OTHER PUBLICATIONS

Daniel et al., "Further investigations of high order ambisonics and wavefield synthesis for holophonic sound imaging", Preprints of papers presented at the AES Convention, Mar. 22, 2003, pp. 1-18.
(Continued)

*Primary Examiner* — Maria El-Zoobi

(57) ABSTRACT

Higher Order Ambisonics (HOA) represents three-dimensional sound. HOA provides high spatial resolution and facilitates analyzing of the sound field with respect to dominant sound sources. The invention aims to identify independent dominant sound sources constituting the sound field, and to track their temporal trajectories. Known applications are searching for all potential candidates for dominant sound source directions by looking at the directional power distribution of the original HOA representation, whereas in the invention all components which are correlated with the signals of previously found sound sources are
(Continued)

Figure 1:
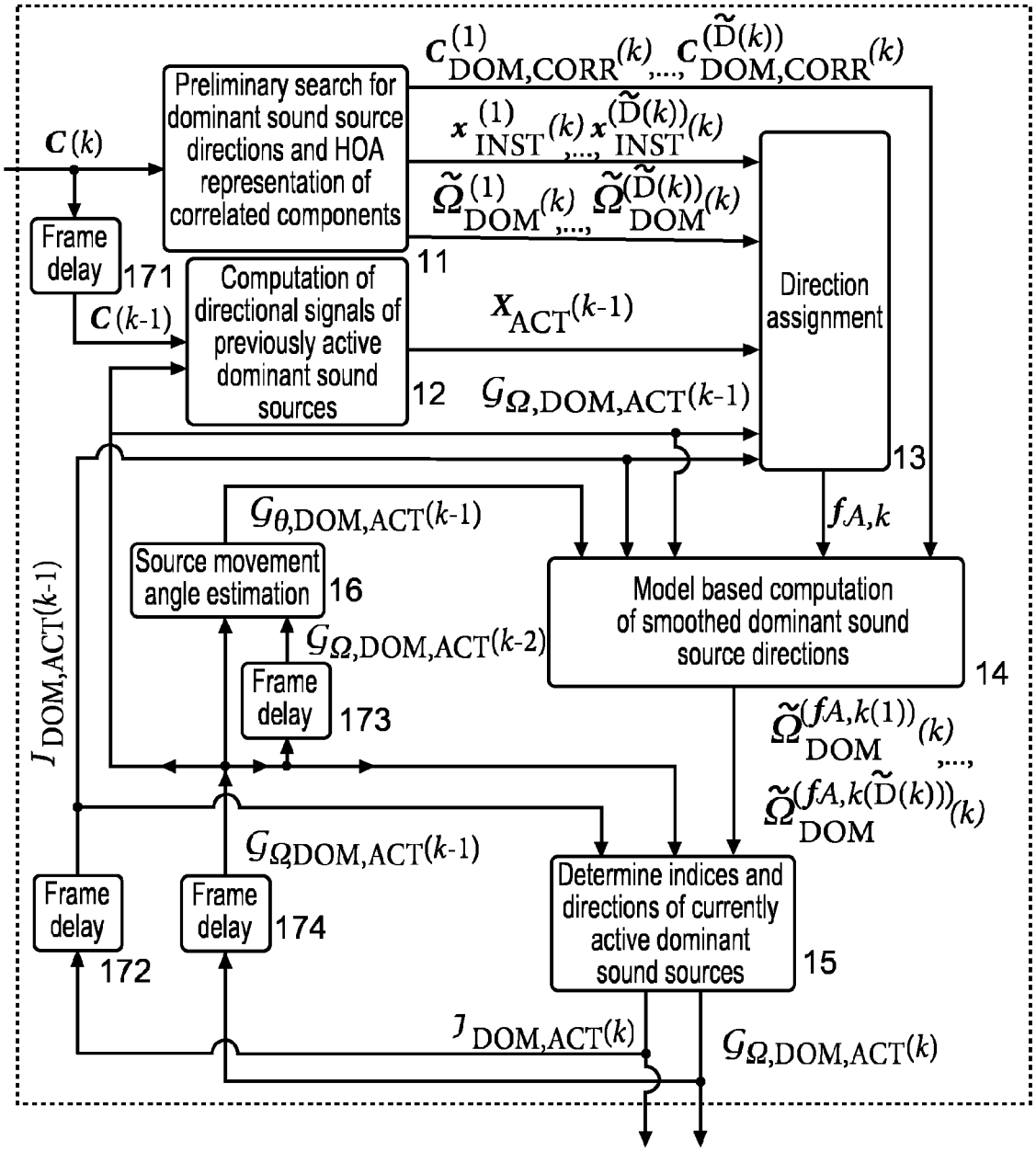

removed. By such operation the problem of erroneously detecting many instead of only one correct sound source can be avoided in case its contributions to the sound field are highly directionally dispersed.

10 Claims, 5 Drawing Sheets

(51) Int. Cl.
*G10L 19/008* (2013.01)
*G10L 21/0272* (2013.01)

(56) References Cited

FOREIGN PATENT DOCUMENTS

| | | |
|---|---|---|
| CN | 102089634 | 6/2011 |
| EP | 2469741 | 6/2012 |
| EP | 2665208 | 11/2013 |
| EP | 2738962 | 6/2014 |

OTHER PUBLICATIONS

Hellerud et al., "Spatial redundancy in Higher Order Ambisonics and its use for low delay lossless compression", IEEE International Conference on Acoustics, Speech and Signal Processing, Piscataway, USA, Apr. 19, 2009, pp. 269-272.
Sun et al., "Optimal 3-D HOA encoding with applications in improving close-spaced source localization", IEEE Workshop on Applications of Signal processing to Audio and Acoustics, Oct. 16, 2011, pp. 249-252.
Kuhn et al., "The Hungarian method for the assignment problem", Naval and Research Logistics Quarterly 2, No. 1-2, pp. 83-97, Mar. 1955.
Poletti et al., "Three-Dimensional Surround Sound Systems Based on Spherical Harmonics", J. Audio Eng. Soc., vol. 53(11), pp. 1004-1025, Nov. 2005.
Rafaely et al., "Plane-wave decomposition of the sound field on a sphere by sperical convolution"J. Acoust, Soc. Am., 4(116), Oct. 2004, pp. 2149-2157.
Williams, "Fourier Acoustics", Acedemic Press, Jun. 10, 1999, Abstract, ISBN 978-0127539607; pp. 1-5.
Search Report Dated May 14, 2014.

* cited by examiner

METHOD AND APPARATUS FOR DETERMINING DIRECTIONS OF UNCORRELATED SOUND SOURCES IN A HIGHER ORDER AMBISONICS REPRESENTATION OF A SOUND FIELD

This application claims the benefit, under 35 U.S.C. §365 of International Application PCT/EP2014/052479, filed Feb. 7, 2014, which was published in accordance with PCT Article 21(2) on Aug. 14, 2014 in English and which claims the benefit of European patent application No. 13305156.5, filed Feb. 8, 2013.

The invention relates to a method and to an apparatus for determining directions of uncorrelated sound sources in a Higher Order Ambisonics representation of a sound field.

BACKGROUND

Higher Order Ambisonics (HOA) offers one possibility to represent three-dimensional sound among other techniques like wave field synthesis (WFS) or channel based approaches like 22.2. In contrast to channel based methods, however, the HOA representation offers the advantage of being independent of a specific loudspeaker set-up. This flexibility, however, is at the expense of a decoding process which is required for the playback of the HOA representation on a particular loudspeaker set-up. Compared to the WFS approach, where the number of required loudspeakers is usually very large, HOA may also be rendered to set-ups consisting of only few loudspeakers. A further advantage of HOA is that the same representation can also be employed without any modification for binaural rendering to headphones.

HOA is based on a representation of the spatial density of complex harmonic plane wave amplitudes by a truncated Spherical Harmonics (SH) expansion. Each expansion coefficient is a function of angular frequency, which can be equivalently represented by a time domain function. Hence, without loss of generality, the complete HOA sound field representation actually can be assumed to consist of O time domain functions, where O denotes the number of expansion coefficients. In the following, these time domain functions are referred to as HOA coefficient sequences or as HOA channels.

HOA has the potential to provide a high spatial resolution, which improves with a growing maximum order N of the expansion. It offers the possibility of analysing the sound field with respect to dominant sound sources.

Invention

An application could be how to identify from a given HOA representation independent dominant sound sources constituting the sound field, and how to track their temporal trajectories. Such operations are required e.g. for the compression of HOA representations by decomposition of the sound field into dominant directional signals and a remaining ambient component as described in patent application EP 12305537.8. A further application for such direction tracking method would be a coarse preliminary source separation. It could also be possible to use the estimated direction trajectories for the post-production of HOA sound field recordings in order to amplify or to attenuate the signals of particular sound sources.

In EP 12305537.8 it is proposed to successively perform the following three operations:

The number of currently present dominant sound sources within a time frame is identified and the corresponding directions are searched for. The number of dominant sound sources is determined from the eigenvalues of the HOA channel cross-correlation matrix. For the search of the dominant sound source directions the directional power distribution corresponding to a frame of HOA coefficients for a fixed high number of predefined test directions is evaluated. The first direction estimate is obtained by looking for the maximum in the directional power distribution. Then, the remaining identified directions are found by consecutively repeating the following two operations: the test directions in the spatial neighbourhood are eliminated from the remaining set of test directions and the resulting set is considered for the search of the maximum of the directional power distribution.

The estimated directions are assigned to the sound sources deemed to be active in the last time frame.

Following the assignment, an appropriate smoothing of the direction estimates is performed in order to obtain a temporally smooth direction trajectory.

However, although with such processing the temporal smoothing of the direction estimates is accomplished in principle by computing the exponentially-weighted moving average, this technique has the disadvantage of not being able to accurately capture abrupt direction changes or onsets of new dominant sounds.

To overcome this problem, it was suggested in patent application EP 12306485.9 to introduce a simple statistical source movement prediction model, which is employed for a statistically motivated smoothing implemented by the Bayesian learning rule. However, EP 12306485.9 and EP 12305537.8 compute the likelihood function for the sound source directions only from the directional power distribution. This distribution represents the power of a high number of general plane waves from directions specified by nearly uniformly distributed sampling points on the unit sphere. It does not provide any information about the mutual correlation between general plane waves from different directions. In practice, the order N of the HOA representation is usually limited, resulting in a spatially band-limited sound field. In particular, this means that the contribution of a directional sound source to the directional power distribution is smeared around the true direction of incidence to directions in the neighbourhood. This smearing effect is mathematically described by a 'dispersion function', see below section Spatial resolution of Higher Order Ambisonics. Its extent grows with a decreasing order of the HOA representation. The EP 12306485.9 and EP 12305537.8 direction tracking methods, are considering this effect to a certain degree by constraining the search of directions to areas outside the neighbourhood of previously found directions. However, the specification of the neighbourhood assumes that all sound sources are encoded with the full order N of the HOA representation. This assumption is violated for HOA representations of order N which contain general plane waves encoded in a lower order than N. Such general plane waves of lower order than N may be the result of artistic creation in order to make sound sources appearing wider. However, they also occur with the recording of HOA sound field representations by spherical microphones.

The EP 12306485.9 and EP 12305537.8 direction tracking methods would identify more than a single sound source in case the sound field consists of a single general plane wave of lower order than N, which is an undesired property.

A problem to be solved by the invention is to improve the determination of dominant sound sources in an HOA sound field, such that their temporal trajectories can be tracked.

This problem is solved by the methods disclosed in claims 1, 2 and 6. An apparatus that utilises the method of claim 6 is disclosed in claim 7.

The invention improves the EP 12306485.9 processing. The inventive processing looks for independent dominant sound sources and tracks their directions over time. The expression 'independent dominant sound sources' means that the signals of the respective sound sources are uncorrelated. While the state-of-the-art methods EP 12305537.8 and EP 12306485.9 are searching for all potential candidates for dominant sound source directions by looking at the directional power distribution of the original HOA representation only, the inventive processing described below removes for the search of each direction candidate from the original HOA representation all the components which are correlated with the signals of previously found sound sources. By such operation the problem of erroneously detecting many instead of only one correct sound source can be avoided in case its contributions to the sound field are highly directionally dispersed. As mentioned above, such an effect would occur for HOA representations of order N which contain general plane waves encoded in an order lower than N.

Like in EP 12306485.9, the candidates found for the dominant sound source directions are then assigned to previously found dominant sound sources and are finally smoothed according to a statistical source movement model. Hence, like in EP 12306485.9 the inventive processing provides temporally smooth direction estimates, and is able to capture abrupt direction changes or onsets of new dominant sounds.

The inventive processing determines estimates of dominant sound source directions for successive frames of an HOA representation in two subsequent processings:

From a current time frame k of an HOA representation, candidates or estimates for dominant sound source directions are successively searched, and the components of the HOA representation, which are supposed to be created by the respectine sound sources, are determined. In each iteration of this search process each further direction candidate is computed from a residual HOA representation which represents the original HOA representation from which all the components correlated with the signals of previously found sound sources have been removed. The current direction candidate is selected out of a number of predefined test directions, such that the power of the related general plane wave of the residual HOA representation, impinging from the chosen direction on the listener position, is maximum compared to that of all other test directions.

Next, the selected direction candidates for the current time frame are assigned to dominant sound sources found in the previous time frame k−1 of HOA coefficients. Thereafter the final direction estimates, which are smoothed with respect to the resulting time trajectory, are computed by carrying out a Bayesian inference process, wherein this Bayesian inference process exploits on one hand a statistical a priori sound source movement model and, on the other hand, the directional power distributions of the dominant sound source components of the original HOA representation. That a priori sound source movement model statistically predicts the current movement of individual sound sources from their direction in the previous time frame k−1 and movement between the previous time frame k−1 and the penultimate time frame k−2.

The assignment of direction estimates to dominant sound sources found in the previous time frame (k−1) of HOA coefficients is accomplished by a joint minimisation of the angles between pairs of a direction estimate and the direction of a previously found sound source, and maximisation of the absolute value of the correlation coefficient between the pairs of the directional signals related to a direction estimate and to a dominant sound source found in the previous time frame.

In principle, the inventive method is suited for determining directions of uncorrelated sound sources in a Higher Order Ambisonics representation denoted HOA of a sound field, said method including the steps:

in a current time frame of HOA coefficients, searching successively preliminary direction estimates of dominant sound sources, and computing HOA sound field components which are created by the corresponding dominant sound sources, and computing the corresponding directional signals;

assigning said computed dominant sound sources to corresponding sound sources active in the previous time frame of said HOA coefficients by comparing said preliminary direction estimates of said current time frame and smoothed directions of sound sources active in said previous time frame, and by correlating said directional signals of said current time frame and directional signals of sound sources active in said previous time frame, resulting in an assignment function;

computing smoothed dominant source directions using said assignment function, said set of smoothed directions in said previous time frame, a set of indices of active dominant sound sources in said previous time frame, a set of respective source movement angles between the penultimate time frame and said previous time frame, and said HOA sound field components created by the corresponding dominant sound sources;

determining indices and directions of the active dominant sound sources of said current time frame, using said smoothed dominant source directions, the frame delayed version of directions of the active dominant sound sources of said previous time frame and the frame delayed version of indices of the active dominant sound sources of said previous time frame, wherein said directional signals of sound sources active in said previous time frame are computed from said frame delayed version of directions of the active dominant sound sources of said previous time frame and the HOA coefficients of said previous time frame using mode matching, and wherein said set of source movement angles between said penultimate time frame and said previous time frame is computed from said frame delayed version of directions of the active dominant sound sources of said previous time frame and a further frame delayed version thereof.

In principle the inventive apparatus is suited for determining directions of uncorrelated sound sources in a Higher Order Ambisonics representation denoted HOA of a sound field, said apparatus including:

means being adapted for searching successively in a current time frame of HOA coefficients preliminary direction estimates of dominant sound sources, and for computing HOA sound field components which are created by the corresponding dominant sound sources, and for computing the corresponding directional signals;

means being adapted for assigning said computed dominant sound sources to corresponding sound sources active in the previous time frame of said HOA coefficients by comparing said preliminary direction estimates of said current time frame and smoothed directions of sound sources active in said previous time frame, and by correlating said directional signals of said current time frame and directional signals of sound sources active in said previous time frame, resulting in an assignment function;

means being adapted for computing smoothed dominant source directions using said assignment function, said set of smoothed directions in said previous time frame, a set of indices of active dominant sound sources in said previous time frame, a set of respective source movement angles between the penultimate time frame and said previous time frame, and said HOA sound field components created by the corresponding dominant sound sources;

means being adapted for determining indices and directions of the active dominant sound sources of said current time frame, using said smoothed dominant source directions, the frame delayed version of directions of the active dominant sound sources of said previous time frame and the frame delayed version of indices of the active dominant sound sources of said previous time frame, wherein said directional signals of sound sources active in said previous time frame are computed from said frame delayed version of directions of the active dominant sound sources of said previous time frame and the HOA coefficients of said previous time frame using mode matching, and wherein said set of source movement angles between said penultimate time frame and said previous time frame is computed from said frame delayed version of directions of the active dominant sound sources of said previous time frame and a further frame delayed version thereof.

Advantageous additional embodiments of the invention are disclosed in the respective dependent claims.

DRAWINGS

Figure 2:
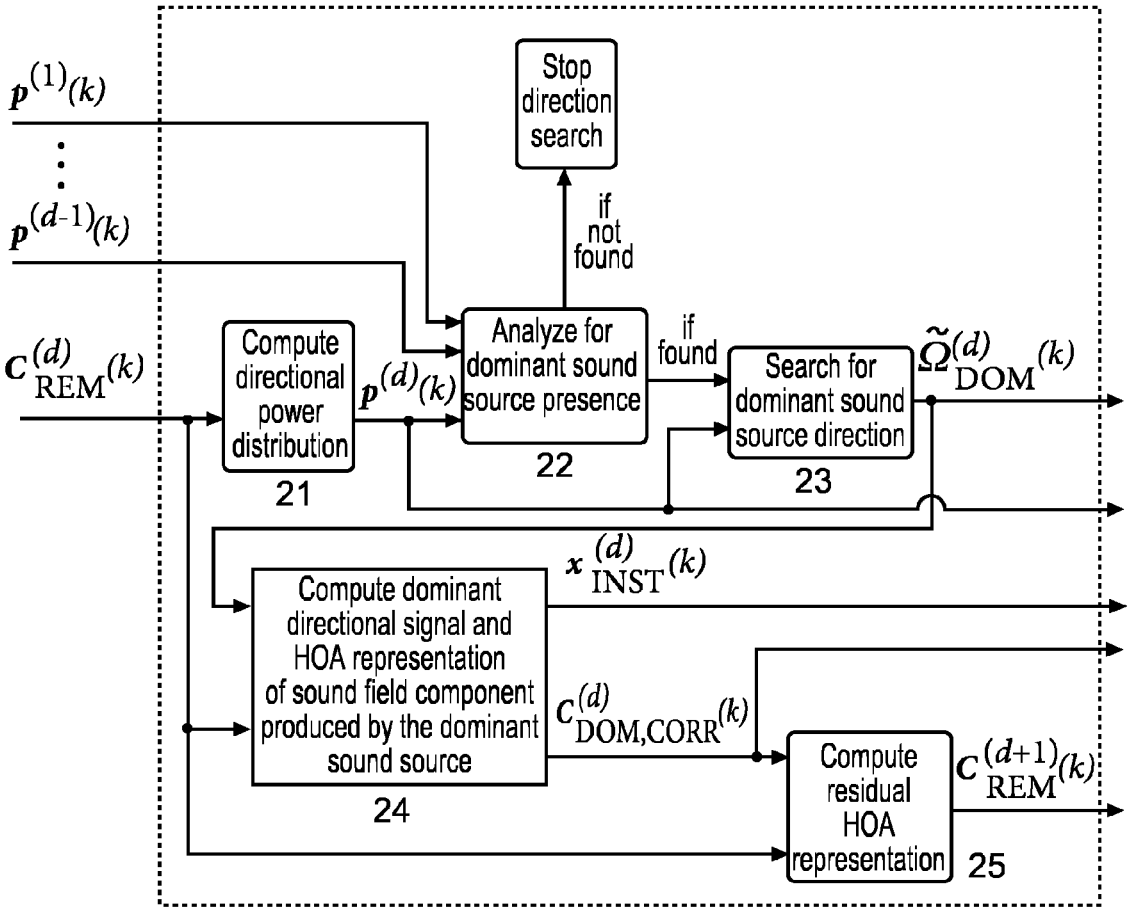
Figure 3:
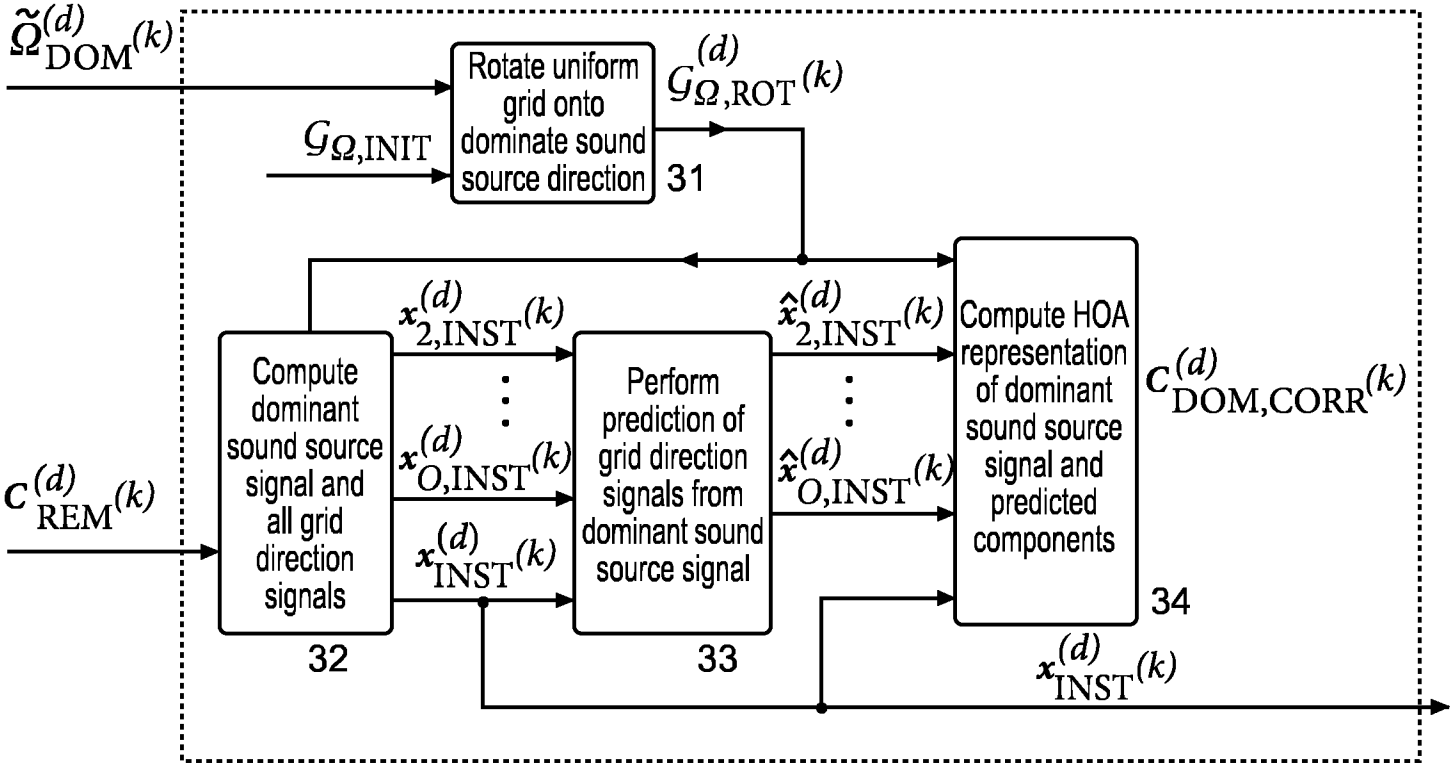
Figure 4:
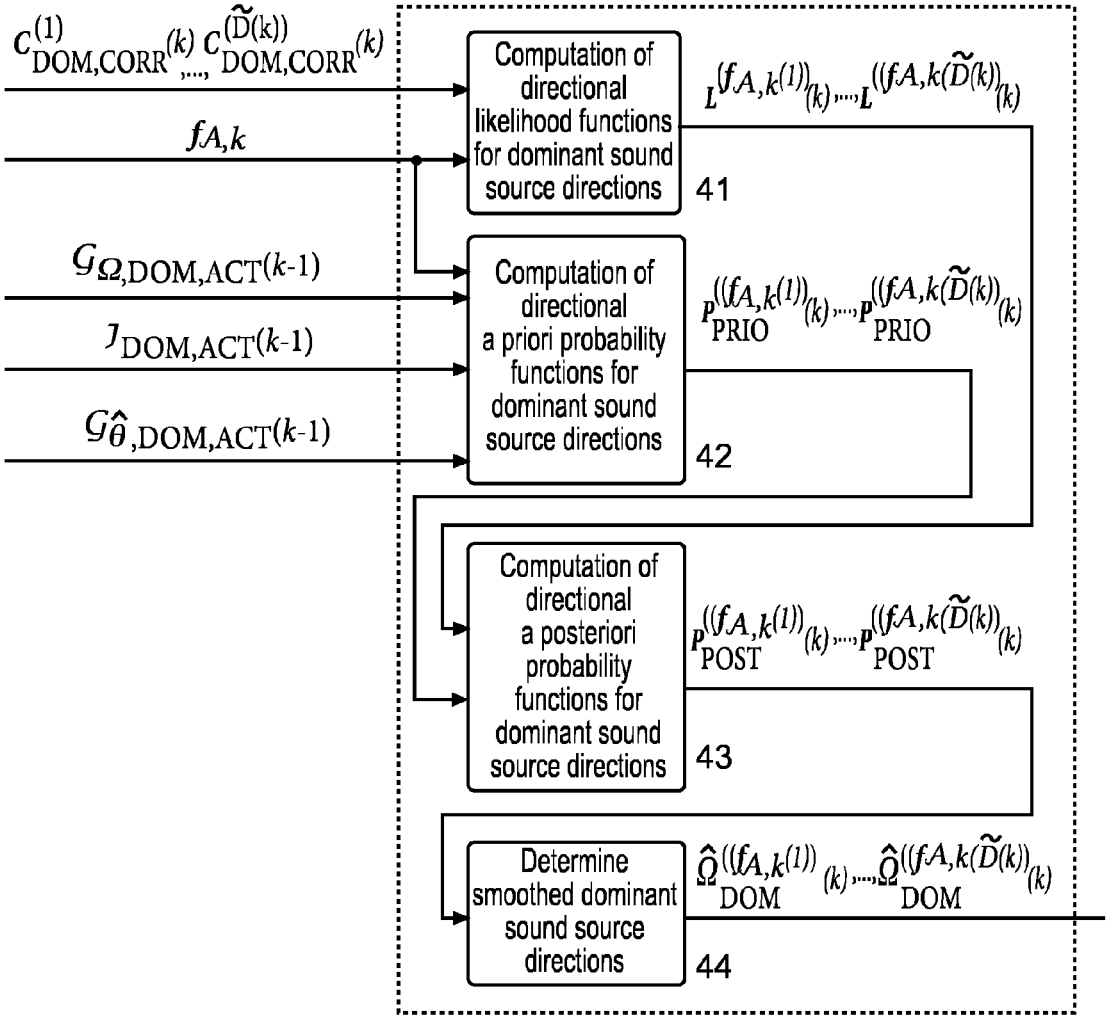
Figure 5:
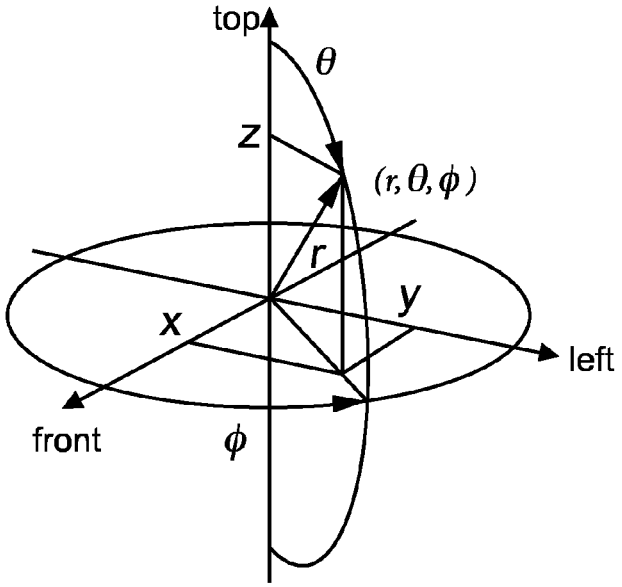
Figure 6:
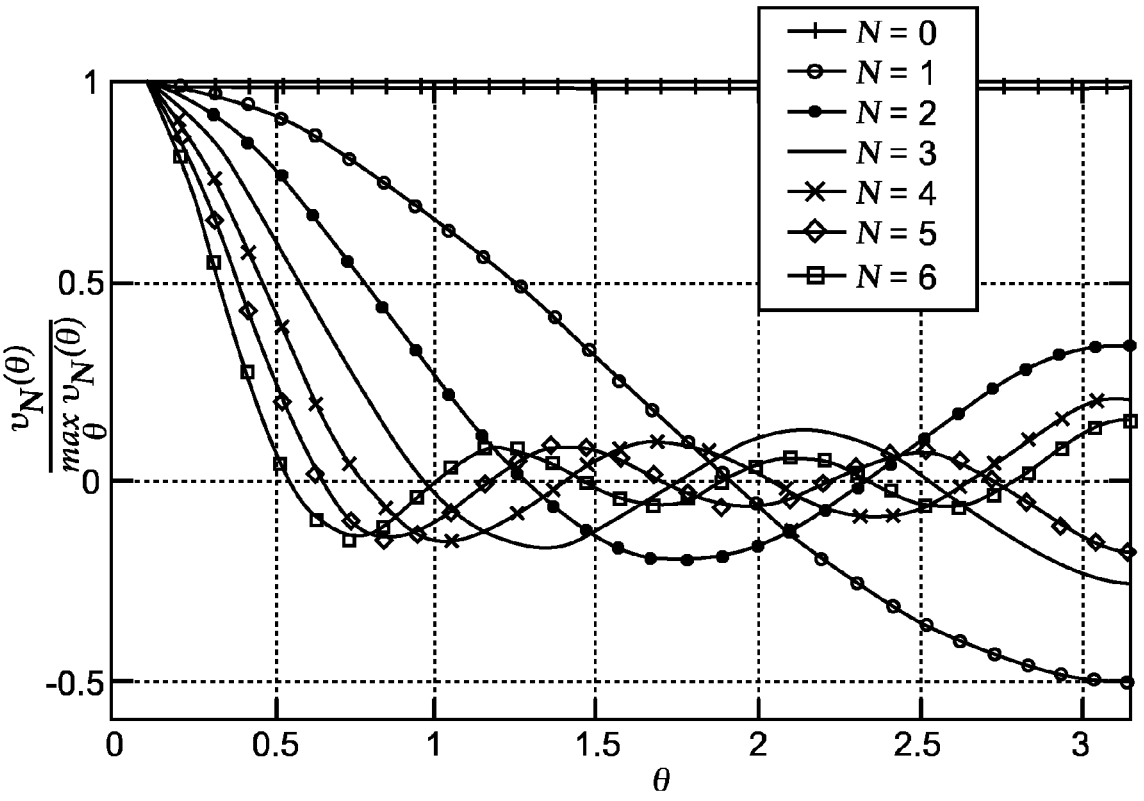

Exemplary embodiments of the invention are described with reference to the accompanying drawings, which show in:

FIG. 1 Block diagram of the inventive processing for estimation of the directions of dominant and uncorrelated directional signals of a Higher Order Ambisonics signal;

FIG. 2 Detail of preliminary direction estimation;

FIG. 3 Computation of dominant directional signal and HOA representation of sound field produced by the dominant sound source;

FIG. 4 Model based computation of smoothed dominant sound source directions;

FIG. 5 Spherical coordinate system;

FIG. 6 Normalised dispersion function $\nu_N(\Theta)$ for different Ambisonics orders N and for angles $\theta \epsilon [0,\pi]$.

EXEMPLARY EMBODIMENTS

The principle of the inventive direction tracking processing is illustrated in FIG. 1 and is explained in the following. It is assumed that the direction tracking is based on the successive processing of input frames C(k) of HOA coefficient sequences of length L, where k denotes the frame index. The frames are defined with respect to the HOA coefficient sequences specified in equation (45) in section Basics of Higher Order Ambisonics as $$fC(k):=[c((kB+1)T_S)\ c((kB+2)T_S)\ \ldots\ c((kB+L)T_S)], \quad (1)$$

where $T_S$ denotes the sampling period and $B \leq L$ indicates the frame shift. It is reasonable, but not necessary, to assume that successive frames are overlapping, i.e. $B<L$.

In a first step or stage 11, the k-th frame C(k) of the HOA representation is preliminary analysed for dominant sound sources. A detailed description of this processing is provided in below section Preliminary direction search. In particular, the number $\tilde{D}(k)$ of detected dominant directional signals is determined as well as the corresponding $\tilde{D}(k)$ preliminary direction estimates $\tilde{\Omega}_{DOM}^{(1)}(k), \ldots, \tilde{\Omega}_{DOM}^{(\tilde{D}(k))}(k)$. Additionally, the HOA sound field components $C_{DOM,CORR}^{(d)}(k)$, $d=1, \ldots, \tilde{D}(k)$, which are (supposed to be) created by the corresponding individual dominant sound sources as well as the corresponding instantaneous directional signals $x_{INST}^{(d)}(k)$, $d=1, \ldots, \tilde{D}(k)$ (i.e. general plane wave functions) are computed.

The individual preliminary direction estimates and related quantities are computed in a sequential manner, i.e. first for d=1, then for d=2 and so on. In the first step the directional power distribution of the original HOA representation C(k) is computed as proposed in EP 12305537.8 and successively analysed for the presence of dominant sound sources. In the case that a dominant sound source is detected, the respective preliminary direction estimate $\tilde{\Omega}_{DOM}^{(1)}(k)$ is computed. Additionally, the corresponding directional signal $x_{INST}^{(1)}(k)$ is estimated, together with that component $\tilde{\Omega}_{DOM,CORR}^{(1)}(k)$ of current frame C(k) which is assumed to be created by this sound source. It assumed that $C_{DOM,CORR}^{(1)}(k)$ represents that component of C(k) which is correlated with the directional signal $x_{INST}^{(1)}(k)$. Finally, the HOA component $C_{DOM,CORR}^{(1)}(k)$ is subtracted from C(k) in order to obtain the residual HOA representation $C_{REM}^{(2)}(k)$. The estimation of the d-th ($d \geq 2$) preliminary direction is performed in a completely analogous way as that of the first one, with the only exception of using the residual HOA representation $C_{REM}^{(d)}(k)$ instead of C(k). It is thereby explicitly assured that sound field components created by the found d-th sound source are excluded for the further direction search.

In direction assignment step or stage 13, the dominant sound sources found in step/stage 11 in the k-th frame are assigned to the corresponding sound sources (assumed to be) active in the (k−1)-th frame. On one hand, the assignment is accomplished by comparing the preliminary direction estimates $\tilde{\Omega}_{DOM}^{(1)}(k), \ldots, \tilde{\Omega}_{DOM}^{(\tilde{D}(k))}(k)$ for the current frame (k) and the smoothed directions of sound sources (assumed to be) active in the (k−1)-th frame, which are contained in the set $\mathcal{G}_{\Omega,DOM,ACT}(k-1)$ and whose indices are contained in the set $\mathcal{J}_{DOM,ACT}(k-1)$. On the other hand, for the assignment the correlation between the instantaneous directional signals $x_{INST}^{(d)}(k)$, $d=1, \ldots, \tilde{D}(k)$ of the detected dominant sound sources at frame k and the directional signals $X_{ACT}(k-1)$ of sound sources (assumed to be) active in the (k−1)-th frame is exploited. The result of the assignment is formulated by an assignment function $f_{\mathcal{A},k}:\{1, \ldots, \tilde{D}(k)\} \rightarrow \{1, \ldots, D\}$, where D denotes the maximum number of expected sound sources to be tracked, meaning that the d-th newly found sound source is assigned to the previously active sound source with index $f_{\mathcal{A},k}(d)$.

In a model based computation of smoothed dominant sound source directions step or stage 14 the smoothed dominant source directions $\hat{\Omega}_{DOM}^{(f_{\mathcal{A},k}(d))}(k)$, $d=1, \ldots, \tilde{D}(k)$ are computed, based on the statistical sound source movement model proposed in EP 12306485.9 by using the set $\mathcal{J}_{DOM,ACT}(k-1)$ of the indices of active dominant sound sources at frame (k−1) the set $\mathcal{G}_{\Omega,DOM,ACT}(k-1)$ of the corresponding dominant source direction estimates at frame (k−1) the set $\mathcal{G}_{\hat{\Theta},DOM,ACT}(k-1)$ of the respective source movement angles between the frames (k−2) and (k−1) the HOA sound field components $C_{DOM,CORR}^{(d)}(k)$, d=1, . . . , $\tilde{D}(k)$ which are supposed to be created by the the found dominant sound sources, and the assignment function $f_{\mathcal{A},k}$. A detailed description of this model based smoothing procedure is provided in below section Model based computation of smoothed dominant sound source directions.

In a last step or stage 15, the indices and the directions of the currently active dominant sound sources are determined, which are supposed to be contained in the sets $\mathcal{J}_{DOM,ACT}(k)$ and $\mathcal{G}_{\Omega,DOM,ACT}(k)$, respectively, using the smoothed dominant source directions $\hat{\Omega}_{DOM}^{(f_{\mathcal{A},k}(d))}(k)$, d=1, . . . , $\tilde{D}(k)$ from step/stage 14 and the sets $\mathcal{G}_{\Omega,DOM,ACT}(k-1)$ and $\mathcal{J}_{DOM,ACT}(k-1)$ containing the smoothed directions and respective indices of sound sources assumed to be active in the (k−1)-th frame. This operation has the purpose to not spuriously deactivate sound sources which have not been detected for a small number of successive frames.

Step or stage 12 performs the computation of the directional signals of sound sources supposed to be active in the (k−1)-th frame using the HOA representation C(k−1) of frame k−1 and the set $\mathcal{G}_{\Omega,DOM,ACT}(k-1)$ of smoothed directions of sound sources supposed to be active in the (k−1)-th frame. The computation is based on the principle of mode matching as described in M. A. Poletti, "Three-Dimensional Surround Sound Systems Based on Spherical Harmonics", J. Audio Eng. Soc., vol. 53(11), pp. 1004-1025, 2005.

In a source movement angle estimation step or stage 16, the set $\mathcal{G}_{\hat{\Theta},DOM,ACT}(k-1)$ of movement angles of the dominant active sound sources at frame k−1 is computed from the two sets $\mathcal{G}_{\Omega,DOM,ACT}(k-1)$ and $\mathcal{G}_{\Omega,DOM,ACT}(k-2)$ of smoothed direction estimates of sound sources supposed to be active in the (k−1)-th and (k−2)-th frame, respectively. The movement is understood to happen between frames k−2 and k−1. The movement angle of an active dominant sound source is the arc between its smoothed direction estimate at frame k−2 and that at frame k−1.

Remarks: if no direction estimate for frame k−2 is available for a dominant sound source which is assumed to be active in frame k−1, the respective movement angle can be set to a maximum value of 'π'. In general, when initialising the processing for a first frame k and frame k−1 values are not yet available, the corresponding sets or values to be input in the steps or stages of FIG. 1 are empty or set to zero, respectively.

This operation causes the a-priori probability for the next direction of this sound source to become nearly uniform over all possible directions, cf. below section Determine indices and directions of currently active dominant sound sources.

Frame delays 171 to 174 are delaying the respective signals by one frame.

In the following, the above-mentioned steps and stages are explained in more detail.

Preliminary Direction Search

In the preliminary direction search step/stage 11, the current number $\tilde{D}(k)$ of present dominant sound sources (in frame k) and the respective directions $\tilde{\Omega}_{DOM}^{(d)}(k)$, d=1, . . . , $\tilde{D}(k)$, are estimated. Additionally, the HOA sound field components $C_{DOM,CORR}^{(d)}(k)$, d=1, . . . , $\tilde{D}(k)$ which are supposed to be created by the individual sound sources, as well as the corresponding directional signals $x_{INST}^{(d)}(k)$, d=1, . . . , $\tilde{D}(k)$ (i.e. general plane wave functions) are computed. All the previously enumerated quantities are computed first for direction index d=1, then for d=2 and so on until d=$\tilde{D}(k)$.

The computation procedure for a single direction d index is illustrated in FIG. 2. The remaining HOA representation $C_{REM}^{(d)}(k)$ produced after the estimation of the (d−1)-th direction (related to the estimation of the d-th direction for the k-th time frame) is input to this stage. It is thereby understood that in the beginning of the loop $C_{REM}^{(1)}(k)$ corresponds to the original HOA frame C(k). In a first step or stage 21, the directional power distribution $p^{(d)}(k)$ of the remaining HOA representation $C_{REM}^{(d)}(k)$ is computed for a predefined number of Q discrete test directions $\Omega_q$, q=1, . . . , Q, which are nearly uniformly distributed on the unit sphere. To be more specific, each test direction $\Omega_q$ is defined as a vector containing an inclination angle $\theta_q \in [0,\pi]$ and azimuth angle $\phi_q \in [0,2\pi[$ according to $$\Omega_q := (\theta_q, \phi_q)^T, \tag{2}$$

where $(\bullet)^T$ denotes transposition. The directional power distribution is represented by the vector $$p^{(d)}(k) := (p_1^{(d)}(k), \ldots, p_Q^{(d)}(k))^T, \tag{3}$$

whose components $p_q^{(d)}(k)$ denote the joint power of all dominant sound sources remaining in the representation $C_{REM}^{(d)}(k)$ related to the direction $\Omega_q$ for the k-th time frame. The actual computation of the directional power distribution $p^{(d)}(k)$ from $C_{REM}^{(d)}(k)$ may be performed as proposed in EP 12305537.8. In step or stage 22, the directional power distribution $p^{(d)}(k)$ is analysed for the presence of a dominant sound source. One way of detecting a dominant source is described in below section Analysis for dominant sound source presence. If the absence of a dominant sound source is detected, then the direction search is stopped and the total number of found dominant directions is set to $\tilde{D}(k)$=d−1. Otherwise, if a dominant source is detected, a preliminary estimate of its direction $\tilde{\Omega}_{DOM}^{(d)}(k)$ with respect to the coordinate origin is computed in step or stage 23, see below section Search for dominant sound source direction for details.

Successively, the respective directional signal $x_{INST}^{(d)}(k)$ and the HOA representation $C_{DOM,CORR}^{(d)}(k)$ of the sound field component assumed to be created by the d-th dominant sound source are computed in step or stage 24 as described in more detail in below section Computation of dominant directional signal and HOA representation of sound field produced by the dominant sound source.

Finally, in step or stage 25 the HOA component $C_{DOM,CORR}^{(d)}(k)$ is subtracted from $C_{REM}^{(d)}(k)$ in order to obtain the residual HOA representation $C_{REM}^{(d+1)}(k)$, which is used for the search of the next (i.e. (d+1)-th) directional sound source. It is thereby explicitly assured that sound field components created by the d-th sound source found are excluded for the further direction search.

Analysis for Dominant Sound Source Presence

For detecting the presence of a dominant sound source within the sound field represented by $C_{REM}^{(d)}(k)$, the directional power distributions $p^{(1)}(k)$, . . . , $p^{(d)}(k)$ of the remaining HOA representations $C_{REM}^{(1)}(k)$, . . . , $C_{REM}^{(d)}(k)$ are considered. On one hand, it has been experimentally found that it is reasonable to monitor the variance ratio $$\delta_p^{(d)}(k) := \frac{\mathrm{var}(p^{(d)}(k))}{\mathrm{var}(p^{(1)}(k))}, \tag{4}$$

which can be regarded as a measure for the importance of the sound field represented by the remaining HOA representation $C_{REM}^{(d)}(k)$ compared to the sound field represented by the initial HOA representation C(k). A small ratio $\delta_p^{(d)}(k)$ indicates that none of the sound sources represented by the HOA representation $C_{REM}^{(d)}(k)$ should be considered as being dominant. On the other hand, it is also reasonable to watch the ratio $$\delta_{p,NORM}^{(d)}(k) := \frac{\mathrm{var}\left(p_{NORM}^{(d)}(k)\right)}{\mathrm{var}\left(p_{NORM}^{(d-1)}(k)\right)}, \text{ for } d \geq 2, \tag{5}$$

of the variances of the normalised directional power distributions $p_{NORM}^{(d)}(k)$ and $p_{NORM}^{(d-1)}(k)$. The elements $p_{q,NORM}^{(d)}(k)$, q=1, . . . , Q, of the normalised directional power distribution $$p_{NORM}^{(d)}(k) := (p_{1,NORM}^{(d)}(k), p_{2,NORM}^{(d)}(k), \ldots, p_{Q,NORM}^{(d)}(k))^T \tag{6}$$

are defined in dependence of those of $p^{(d)}(k)$ by $$p_{q,NORM}^{(d)}(k) := \frac{p_q^{(d)}(k)}{\sum_{q'=1}^{Q} p_{q'}^{(d)}(k)}. \tag{7}$$

The variance var $(p_{NORM}^{(d)}(k)$ can be regarded as a measure of the uniformity of the directional power distribution $p^{(d)}(k)$. In particular, the variance is the smaller the more uniform the power is distributed over all directions of incidence. In the limiting case of a spatially diffuse noise, the variance $\mathrm{var}(p_{NORM}^{(d)}(k))$ should approach a value of zero. Based on these considerations, the variance ratio $\delta_{p,NORM}^{(d)}(k)$ indicates whether the directional power of the HOA representation $C_{REM}^{(d)}(k)$ is distributed more uniformly than that of $C_{REM}^{(d-1)}(k)$.

To summarise the above considerations, it can be assumed that there is always at least a single dominant sound source present in the sound field represented by C(k), i.e. $\tilde{D}(k) \geq 1$. Further dominant sources are detected (for d≥2) if the value of the variance ratio $\delta_p^{(d)}(k)$ remains above a certain predefined threshold $\epsilon_p < 1$ and the value of the variance ratio is smaller than one, i.e. Dominant sound source is detected $$(\text{for } d \geq 2) \text{ if } \delta_p^{(d)}(k) \geq \epsilon_p \text{ and } \delta_{p,NORM}^{(d)}(k) < 1 \tag{8}$$

The value for $\epsilon_p$ is to be set with respect to the interpretation of what 'dominant' means. The inventors have found that a reasonable choice is given by $\epsilon_p = 10^{-3}$.

Search for Dominant Sound Source Direction

After the d-th sound source has been detected, a preliminary estimate of its direction $\tilde{\Omega}_{DOM}^{(d)}(k)$ is searched for by employing the directional power distribution $p^{(d)}(k)$. The search is accomplished by taking that test direction $\Omega_q$ for which the directional power is the largest, i.e.

$$\tilde{\Omega}_{DOM}^{(d)}(k) = \Omega_{q_{MAX}^{(k,d)}}, \text{ where } q_{MAX}^{(k,d)} := \mathrm{argmax}_{1 \leq q \leq Q}\, p_q^{(d)}(k). \tag{9}$$

Computation of Dominant Directional Signal and HOA Representation of Sound Field Produced by the Dominant Sound Source Subsequently, after having determined a preliminary estimate $\tilde{\Omega}_{DOM}^{(d)}(k)$ of the dominant source direction, the respective directional signal $x_{INST}^{(d)}(k)$, as well as the HOA representation $C_{DOM,CORR}^{(d)}(k)$ of the sound field components assumed to be created by the same sound source, are computed according to FIG. 3. In step or stage 31, a fixed predefined spherical grid $\mathcal{G}_{\Omega,INIT}$ consisting of O sampling positions $\Omega_{INIT,o}$, o=1, . . . , O, which are assumed to be nearly uniformly distributed on the unit sphere, is rotated to provide the grid $\mathcal{G}_{\Omega,ROT}^{(d)}(k)$ consisting of the rotated sampling positions $\Omega_{ROT,o}^{(d)}(k)$, o=1, . . . , O. The rotation is performed such that the first rotated sampling position $\Omega_{ROT,1}^{(d)}(k)$ corresponds to the preliminary direction estimate $\tilde{\Omega}_{DOM}^{(d)}(k)$.

In step or stage 32, the HOA representation $C_{REM}^{(d)}(k)$ is transformed to the so-called spatial domain, where it is equivalently represented by O plane wave functions (also referred to as grid directional signals) $x_{o,INST}^{(d)}(k)$, o=1, . . . , O, which are assumed to imping on the observer position (i.e. the coordinate origin) from the rotated grid directions $\Omega_{ROT,o}^{(d)}(k)$, o=1, . . . , O. To compute the plane wave functions $x_{o,INST}^{(d)}(k)$, o=1, . . . , O, the mode matrix $\Xi_{GRID}^{(d)}(k)$ with respect to the rotated grid directions is computed as $$\Xi_{GRID}^{(d)}(k) := [S_{GRID,1}^{(d)}(k)\ S_{GRID,2}^{(d)}(k) \ldots S_{GRID,O}^{(d)}(k)] \in \mathbb{R}^{O \times O} \tag{10}$$

with $$S_{GRID,o}^{(d)}(k) := [S_0^0(\Omega_{ROT,o}^{(d)}(k)), S_1^{-1}(\Omega_{ROT,o}^{(d)}(k)), S_1^0(\Omega_{ROT,o}^{(d)}(k)), \ldots, S_N^N(\Omega_{ROT,o}^{(d)}(k))]^T \in \mathbb{R}^O. \tag{11}$$

Assuming each grid directional signal $x_{o,INST}^{(d)}(k)$ to be a row vector composed of the individual samples of the k-th time frame as $$x_{o,INST}^{(d)}(k) = (x_{o,INST}^{(d)}(k,1), x_{o,INST}^{(d)}(k,2), \ldots, x_{o,INST}^{(d)}(k,L)), \tag{12}$$

where L denotes the length (in samples) of the analysed HOA representation, the computation of all grid directional signals is accomplished by a Spherical Harmonics Transform (see below section Spherical Harmonic Transform for an explanation) as $$\begin{bmatrix} x_{1,INST}^{(d)}(k) \\ x_{2,INST}^{(d)}(k) \\ \vdots \\ x_{O,INST}^{(d)}(k) \end{bmatrix} = \left(\Xi_{GRID}^{(d)}(k)\right)^{-1} C(k). \tag{13}$$

Since the preliminary estimate $\tilde{\Omega}_{DOM}^{(d)}(k)$ of the dominant sound source direction corresponds to the rotated sampling position $\Omega_{ROT,1}^{(d)}(k)$, the general plane wave function $x_{1,INST}^{(d)}(k)$ can be regarded as the desired dominant directional signal $x_{INST}^{(d)}(k)$, $$\text{i.e. } x_{INST}^{(d)}(k) = x_{1,INST}^{(d)}(k) \tag{14}$$

To determine that component of $C_{REM}^{(d)}(k)$ which is produced by the d-th sound source, it is postulated that this component is equivalently represented by plane wave functions that can be predicted from $x_{INST}^{(d)}(k)$ in step or stage 33. Hence, the grid directional signals $x_{o,INST}^{(d)}(k)$, o=2, . . . , O are attempted to be predicted from $x_{INST}^{(d)}(k)$. The predicted signals are denoted by $\hat{x}_{o,INST}^{(d)}(k)$, o=2, . . . , O.

One way of accomplishing such prediction is to assume the predicted signals $\hat{x}_{o,INST}^{(d)}(k)$, o=2, . . . , O, to be created from $x_{INST}^{(d)}(k)$ by linear filtering where the filters are determined so as to minimise the prediction error. If the filters are assumed to be finite impulse response (FIR) filters of a very short duration (compared to that of the analysis frame), the minimisation of the prediction error can be achieved by using state-of-the-art least squares techniques. Finally, the HOA representation of the dominant sound source signal $x_{INST}^{(d)}(k)$ and all predicted correlated components is obtained in step or stage 34 by an inverse Spherical Harmonics Transform (see below section Spherical Harmonic Transform for an explanation) as $$C_{DOM,CORR}^{(d)}(k) = \Xi_{GRID}^{(d)}(k)\begin{bmatrix} x_{INST}^{(d)}(k) \\ \hat{x}_{2,INST}^{(d)}(k) \\ \hat{x}_{3,INST}^{(d)}(k) \\ \hat{x}_{O,INST}^{(d)}(k) \end{bmatrix}. \tag{15}$$

Computation of Directional Signals of Previously Active Dominant Sound Sources

The directional signals $x_{ACT}^{(i_{ACT,k-1}(d'))}(k-1)$ of sound sources supposed to be active in the (k−1)-th frame are contained within matrix $X_{ACT}(k-1)$ according to equation (20). This matrix is computed using the principle of mode matching (see the above-mentioned Poletti article) by $$X_{ACT}(k-1)=(\Xi_{ACT}(k-1))^{-1}C(k-1), \tag{16}$$

where C(k−1) denotes the (k−1)-th frame of the original HOA sound field representation and $\Xi_{ACT}(k-1)$ denotes the mode matrix with respect to the directions $\overline{\Omega}_{DOM,ACT}^{(i_{ACT,k-1}(d'))}(k-1)$, d'=1, . . . , $D_{ACT}(k-1)$, of sound sources supposed to be active in the (k−1)-th frame. The mode matrix $\Xi_{ACT}(k-1)$ is computed by $$\Xi_{ACT}(k-1):=[S_{ACT,1}(k-1),S_{ACT,2}(k-1), \ldots S_{ACT,D_{ACT}(k-1)}(k-1)]\in \mathbb{R}^{O\times D_{ACT}(k-1)} \tag{17}$$

with $$S_{ACT,d'}(k):=[S_0^0(\overline{\Omega}_{DOM,ACT}^{(i_{ACT,k-1}(d'))}(k-1)),S_1^{-1}(\overline{\Omega}_{DOM,ACT}^{(i_{ACT,k-1}(d'))}(k-1)),S_1^1(\overline{\Omega}_{DOM,ACT}^{(i_{ACT,k-1}(d'))}(k-1)),S_N^{-N-1}(\overline{\Omega}_{DOM,ACT}^{(i_{ACT,k-1}(d'))}(k-1)),S_N^N(\overline{\Omega}_{DOM,ACT}^{(i_{ACT,k-1}(d'))}(k-1))]^T\in \mathbb{R}^O. \tag{18}$$

Direction Assignment

As previously mentioned, on one hand the assignment in step/stage 13 of FIG. 1 is accomplished by comparing the preliminary direction estimates $\tilde{\Omega}_{DOM}^{(1)}(k)$, . . . , $\tilde{\Omega}_{DOM}^{(\tilde{D}(k))}(k)$ and the smoothed directions of sound sources supposed to be active in the (k−1)-th frame, which are contained in the set $$\mathcal{G}_{\Omega,DOM,ACT}(k-1):=\{\overline{\Omega}_{DOM,ACT}^{(i_{ACT,k-1}(d'))}(k-1), \ldots, \overline{\Omega}_{DOM,ACT}^{(i_{ACT,k-1}(D_{ACT}(k-1)))}(k-1)\}, \tag{19}$$

where $i_{ACT,k-1}(d')$ denotes the index of the d'-th sound source assumed to be active in the (k−1)-th frame. In particular, it is assumed that the smaller the angle $$\angle(\tilde{\Omega}_{DOM}^{(d)}(k),\overline{\Omega}_{DOM,ACT}^{(i_{ACT,k-1}(d'))}(k-1))$$

between a pair of a preliminary direction estimate $\tilde{\Omega}_{DOM}^{(d)}(k)$ and a smoothed direction $\overline{\Omega}_{DOM,ACT}^{(i_{ACT,k-1}(d'))}(k-1)$, the more likely the d-th newly found dominant sound source direction will correspond to the previously active sound source with index $i_{ACT,k-1}(d')$.

On the other hand, for the assignment the correlation between the instantaneous directional signals $x_{INST}^{(d)}(k)$, d=1, . . . , $\tilde{D}(k)$ of the detected dominant sound sources at frame k and the directional signals $X_{ACT}(k-1)$ of sound sources supposed to be active in the (k−1)-th frame is exploited. It is here assumed that the frame $X_{ACT}(k-1)$ is composed of the individual directional signals $x_{ACT}^{(i_{ACT,k-1}(d'))}(k-1)$ of sound sources supposed to be active in the (k−1)-th frame as $$X_{ACT}(k-1):=\begin{bmatrix} x_{ACT}^{(i_{ACT,k-1}(1))}(k-1) \\ x_{ACT}^{(i_{ACT,k-1}(2))}(k-1) \\ \vdots \\ x_{ACT}^{(i_{ACT,k-1}(D_{ACT}(k-1)))}(k-1) \end{bmatrix}. \tag{20}$$

Using this definition, it is postulated that the higher the absolute value of the correlation coefficient $$\rho_{CORR}(x_{INST}^{(d)}(k),x_{ACT}^{(i_{ACT,k-1}(d'))}(k-1))$$

between the two signals $x_{INST}^{(d)}(k)$ and $x_{ACT}^{(i_{ACT,k-1}(d'))}(k-1)$ is, the more likely the d-th newly found dominant sound source direction will correspond to the previously active sound source with index $i_{ACT,k-1}(d')$. Such postulation is justified by the fact that the correlation coefficient provides a measure for the linear dependency between two signals.

Based on these considerations, an assignment function $$f_{A,k}:\{1, \ldots, \tilde{D}(k)\}\rightarrow\{1, \ldots, D\}$$

specifying the assignment is computed such as to minimise the following cost function $$\Sigma_{d=1}^{\tilde{D}(K)}[\angle(\tilde{\Omega}_{DOM}^{(d)}(k),\overline{\Omega}_{DOM,ACT}^{(f_{A,k}(d))}(k-1))]\cdot[1-|\rho_{CORR}(x_{INST}^{(d)}(k),x_{ACT}^{(f_{A,k}(d))}(k-1)|]. \tag{21}$$

It is implicitly assumed that for the direction indices d"$\epsilon\{1, \ldots, D\}\backslash\mathcal{J}_{DOM,ACT}(k-1)$, which do not belong to any active sound source in the (k−1)-th frame, the angles $$\angle(\tilde{\Omega}_{DOM}^{(d)}(k),\overline{\Omega}_{DOM,ACT}^{(d'')}(k-1))$$

are virtually set to a minimum angle of $\Theta_{MIN}$, where e.g. $\Theta_{MIN}=2\pi/N$. Further, the correlation coefficients $$\rho_{CORR}(x_{INST}^{(d)}(k),x_{ACT}^{(d'')}(k-1))$$

for the direction indices d"$\epsilon\{1, \ldots, D\}\backslash\mathcal{J}_{DOM,ACT}(k-1)$ are virtually set to zero. The first operation has the effect that, if the angles between the d-th newly found direction $\tilde{\Omega}_{DOM}^{(d)}(k)$ and the directions of all previously active dominant sound sources are greater than $\Theta_{MIN}$, this newly found direction is favoured to belong to a new sound source.

The assignment problem can be solved by using the well-known Hungarian algorithm described in H. W. Kuhn, "The Hungarian method for the assignment problem", Naval research logistics quarterly, vol. 2(1-2), pp. 83-97, 1955.

Model Based Computation of Smoothed Dominant Sound Source Directions

This section addresses the computation of the smoothed dominant sound source directions in step/stage 14 of FIG. 1 according to a statistical sound source movement model. The individual steps for this computation are illustrated in FIG. 4 and are explained in detail in the following.

Computation of Directional a Priori Probability Functions for Dominant Sound Source Directions The directional a priori probability functions $P_{PRIO}(f_{A,k}(d))(k)$, d=1, . . . , $\tilde{D}(k)$, for the newly found dominant sound source directions are computed in step or stage 42 using:

the set $\mathcal{J}_{DOM,ACT}(k-1)$ of the indices $i_{ACT,k-1}(d')$, d'=1, . . . , $D_{ACT}(k-1)$, of active dominant sound sources at frame (k−1), the set $\mathcal{G}_{\Omega,DOM,ACT}(k-1)$ of the corresponding dominant source direction estimates $\overline{\Omega}_{DOM,ACT}^{(i_{ACT,k-1}(d'))}(k-1)$, d'=1, . . . , $D_{ACT}(k-1)$ at frame (k−1), the set $\mathcal{G}_{\hat{\Theta},DOM,ACT}(k-1)$ of the respective source movement angles $\Theta_{i_{ACT,k-1}(d')}(k-1)$, d'=1, . . . , $D_{ACT}(k-1)$, between the frame (k−2) and (k−1), and the assignment function $f_{\mathcal{A},k}$.

The computation is based on a simple sound source movement prediction model introduced in EP 12306485.9. In particular, the directional a priori probability function $P_{PRIO}(f_{\mathcal{A},k}^{(d)})(k)$ for the d-th newly found dominant sound source is assumed to be a discrete version of the von Mises-Fisher distribution on the unit sphere in the three-dimensional space.

In the following it is assumed that the directional a priori probability function $P_{PRIO}(f_{\mathcal{A},k}^{(d)})(k)$ is given by a vector composed of the probabilities $P_{PRIO}(f_{\mathcal{A},k}^{(d)})(k,\Omega_q)$ for the individual test di-reactions $$\Omega_q,\ q=1,\ldots,Q,\ \text{as}\ P_{PRIO}(f_{\mathcal{A},k}^{(d)})(k):=[P_{PRIO}(f_{\mathcal{A},k}^{(d)})(k,\Omega_1)\ P_{PRIO}(f_{\mathcal{A},k}^{(d)})(k,\Omega_2)\ldots P_{PRIO}(f_{\mathcal{A},k}^{(d)})(k,\Omega_Q)]^T\in\mathbb{R}^Q. \tag{22}$$

To compute the a priori probabilities for the individual test directions $\Omega_q$ two cases are to be distinguished:

a) If the source index $f_{\mathcal{A},k}(d)$ assigned to the d-th newly found dominant sound source is contained within the set $\mathcal{J}_{DOM,ACT}(k-1)$, the a priori probabilities are computed according to $$P_{PRIO}^{(f_{\mathcal{A},k}(d))}(k,\Omega_q)=\frac{\kappa_d(k)}{Q\sinh(\kappa_d(k))}\exp\{\kappa_d(k)\cos(\Theta_{q,d}(k))\}\quad \text{for } q=1,\ldots,Q, \tag{23}$$

where $\Theta_{q,d}(k)$ denotes the angle between the estimated direction $\overline{\Omega}_{DOM,ACT}(f_{\mathcal{A},k}^{(d)})(k-1)$ and the test direction $\Omega_q$, i.e.

$$\Theta_{q,d}(k):=\angle(\overline{\Omega}_{DOM,ACT}(f_{\mathcal{A},k}^{(d)})(k-1),\Omega_q). \tag{24}$$

Further, $\kappa_d(k)$ denotes a concentration parameter that is computed using the source movement angle estimate $\hat{\Theta}_{f_{\mathcal{A},k}(d)}(k-1)$ according to $$\kappa_d(k)=\frac{\ln(C_R)}{\cos\left(\hat{\Theta}_{f_{\mathcal{A},k}(d)}(k-1)\right)-1-C_D}, \tag{25}$$

where $C_D$ may be set to $$C_D=\frac{\ln(C_R)}{-\kappa_{MAX}}. \tag{26}$$

Reasonable values for the parameters $\kappa_{MAX}$ and $C_R$ have been found to be (see EP 12306485.9)

$$\kappa_{MAX}=8,\ C_R=0.5. \tag{27}$$

The principle behind this computation is to increase the concentration of the a priori probability function the less the sound source has moved before. If the sound source has moved a lot before, the uncertainty about its successive direction is high and thus the concentration parameter has to achieve a small value.

b) If the source index $f_{\mathcal{A},k}(d)$ assigned to the d-th newly found dominant sound source is not contained within the set $\mathcal{J}_{DOM,ACT}(k-1)$, then the respective sound source is considered to not having been active before. Consequently, no a priori knowledge about the direction of this source is actually available. Hence, the a priori probability function $P_{PRIO}(f_{\mathcal{A},k}^{(d)})(k)$ is assumed to be uniform on the unit sphere, where the individual probabilities are equal for all test positions $\Omega_q$, $$\text{i.e.}\ P_{PRIO}^{(f_{\mathcal{A},k}(d))}(k,\Omega_q)=\frac{1}{Q}\quad \text{for } q=1,\ldots,Q. \tag{28}$$

Computation of Directional Likelihood Functions for Dominant Sound Source Directions The directional likelihood functions $L(f_{\mathcal{A},k}^{(d)})(k)$, d=1, . . . , $\tilde{D}(k)$, are computed in step or stage 41 using the HOA sound field components $C_{DOM,CORR}^{(d)}(k)$, d=1, . . . , $\tilde{D}(k)$, which are supposed to be created by the individual newly detected dominant sound sources, as well as the assignment function $f_{\mathcal{A},k}$. The directional likelihood function $L(f_{\mathcal{A},k}^{(d)})(k)$ is assumed to be a vector composed of the likelihoods $L(f_{\mathcal{A},k}^{(d)})(k,\Omega_q)$ for the individual test directions $\Omega_q$, q=1, . . . , Q, as $$L(f_{\mathcal{A},k}^{(d)})(k):=[L(f_{\mathcal{A},k}^{(d)})(k,\Omega_1)\ L(f_{\mathcal{A},k}^{(d)})(k,\Omega_2)\ldots L(f_{\mathcal{A},k}^{(d)})(k,\Omega_Q)]^T\in\mathbb{R}^Q. \tag{29}$$

The individual likelihoods $L(f_{\mathcal{A},k}^{(d)})(k,\Omega_q)$ are computed to be approximations of the powers of general plane waves impinging from the test direction $\Omega_q$, as described in EP 12305537.8. In particular, $$L(f_{\mathcal{A},k}^{(d)})(k,\Omega_q)=(S_{TEST,q})^T\Sigma_{DOM,CORR}^{(d)}(k)S_{TEST,q}\quad \text{for } q=1,\ldots,Q, \tag{30}$$

where $$S_{TEST,q}:=[S_0^0(\Omega_q),S_1^{-1}(\Omega_q),S_1^0(\Omega_q),S_1^1(\Omega_q),\ldots,S_N^{N-1}(\Omega_q),S_N^N(\Omega_q)]^T\in\mathbb{R}^O \tag{31}$$

denotes the mode vector with respect to the test direction $\Omega_q$ (with $S_n^m(\bullet)$ representing the real valued Spherical Harmonics defined in below section Definition of real valued Spherical Harmonics) and where $$\Sigma_{DOM,CORR}^{(d)}(k):=C_{DOM,CORR}^{(d)}(k)(C_{DOM,CORR}^{(d)}(k))^T \tag{32}$$

indicates the HOA inter-coefficients correlation matrix with respect to the HOA representation $C_{DOM,CORR}^{(d)}(k)$.

Computation of Directional a Posteriori Probability Functions for Dominant Sound Source Directions The directional a posteriori probability functions $P_{POST}(f_{\mathcal{A},k}^{(d)})(k)$, d=1, . . . , $\tilde{D}(k)$, are computed in step or stage 43 using the directional a priori probability functions $P_{PRIO}(f_{\mathcal{A},k}^{(d)})(k)$, d=1, . . . , $\tilde{D}(k)$ and the directional likelihood functions $L(f_{\mathcal{A},k}^{(d)})(k)$, d=1, . . . , $\tilde{D}(k)$ Here, once again, the directional a posteriori probability function $P_{POST}(f_{\mathcal{A},k}^{(d)})(k)$ is assumed to be a vector composed of the a posteriori probabilities $P_{POST}(f_{\mathcal{A},k}^{(d)})(k,\Omega_q)$ for the individual test directions $\Omega_q$, q=1, . . . Q, as $$P_{POST}(f_{\mathcal{A},k}^{(d)})(k):=[P_{POST}(f_{\mathcal{A},k}^{(d)})(k,\Omega_1)\ P_{POST}(f_{\mathcal{A},k}^{(d)})(k,\Omega_2)\ldots P_{POST}(f_{\mathcal{A},k}^{(d)})(k,\Omega_Q)]^T\in\mathbb{R}^Q. \tag{33}$$

The individual a posteriori probabilities $P_{POST}(f_{\mathcal{A},k}^{(d)})(k,\Omega_q)$ are computed according to the Bayesian rule (see EP 12306485.9) as $$P_{POST}^{(f_{\mathcal{A},k}(d))}(k,\Omega_q)=\frac{P_{PRIO}^{(f_{\mathcal{A},k}(d))}(k,\Omega_q)L^{(f_{\mathcal{A},k}(d))}(k,\Omega_q)}{\sum_{q'=1}^{Q}P_{PRIO}^{(f_{\mathcal{A},k}(d))}(k,\Omega_{q'})L^{(f_{\mathcal{A},k}(d))}(k,\Omega_{q'})} \quad (34)$$

for $q=1,\ldots,Q$.

Assuming a fixed direction index d the denominator of equation (37) is constant for each test direction $\Omega_q$. For the purpose of the following direction search, where only the maximum of the a posteriori probability functions is of interest, such a global scaling is irrelevant. Hence, it is noted that the computation of the denominator of equation (37) may be completely waived to save computational power.

Computation of Smoothed Dominant Sound Source Directions

The smoothed dominant sound source directions $\hat{\Omega}_{DOM}^{(f_{\mathcal{A},k}(d))}(k)$, d=1, . . . , $\tilde{D}(k)$, are computed in step or stage 44 using the a posteriori probability functions $P_{POST}^{(f_{\mathcal{A},k}(d))}(k)$, d=1, . . . , $\tilde{D}(k)$. In particular, the smoothed direction $\hat{\Omega}_{DOM}^{(f_{\mathcal{A},k}(d))}(k)$ of the d-th sound source found for frame k is obtained by searching for the maximum in the a posteriori probability function $$P_{POST}^{(f_{\mathcal{A},k}(d))}(k),\ \text{i.e.}\ \hat{\Omega}_{DOM}^{(f_{\mathcal{A},k}(d))}(k)=\operatorname{argmax}_{\Omega_q}P_{POST}^{(f_{\mathcal{A},k}(d))}(k,\Omega_q). \quad (35)$$

Determine Indices and Directions of Currently Active Dominant Sound Sources

The set $\mathcal{I}_{DOM,ACT}(k)$ of the indices $i_{ACT,k}(d')$, d'=1, . . . , $D_{ACT}(k)$ of all $D_{ACT}(k)$ active dominant sound sources at frame k and the set $\mathcal{G}_{\Omega,DOM,ACT}(k)$ of the corresponding dominant source direction estimates $\overline{\Omega}_{DOM,ACT}^{(i_{ACT,k}(d'))}(k)$, d'=1, . . . , $D_{ACT}(k)$, at frame k are computed in step or stage 15 of FIG. 1 using the set $\mathcal{G}_{\Omega DOM,ACT}(k-1)$ of the smoothed estimates $\overline{\Omega}_{DOM,ACT}^{(i_{ACT,k-1}(d'))}(k-1)$, d'=1, . . . , $D_{ACT}(k-1)$, of all active dominant sound source directions at frame (k−1), the set $\mathcal{I}_{DOM,ACT}(k-1)$ of the corresponding indices $i_{ACT,k-1}(d')$, d'=1, . . . , $D_{ACT}(k-1)$, and the smoothed dominant sound source direction estimates $\hat{\Omega}_{DOM}^{(f_{\mathcal{A},k}(d))}(k)$, d=1, . . . , $\tilde{D}(k)$ obtained for frame k. This operation has the purpose of not spuriously deactivating sound sources which have not been detected for a small number of successive frames, which might happen for sources like e.g. castanets producing impulse-like sounds with short pauses between the individual impulses. Thus, it is reasonable to deactivate sound sources which were assumed to be active in the last (i.e. the (k−1)-th) frame, only if they have not been detected for a predefined number $K_{INACT}$ of successive frames. According to the previous considerations, in a first step the joined set $\mathcal{I}_{JOINED}(k)$ of the set $\mathcal{I}_{DOM,ACT}(k-1)$ of the indices $i_{ACT,k-1}(d')$, d'=1, . . . , $D_{ACT}(k-1)$ of all $D_{ACT}(k-1)$ active dominant sound sources at frame (k−1) and the set $$\mathcal{I}_{NEW}(k):=\{f_{\mathcal{A},k}(d)\,|\,1\le d\le\tilde{D}(k)\} \quad (36)$$

of the indices of all newly detected sound sources are computed $$\mathcal{I}_{JOINED}(k):=\mathcal{I}_{NEW}(k)\cup\mathcal{I}_{DOM,ACT}(k-1). \quad (37)$$

From this set the desired set $\mathcal{I}_{DOM,ACT}(k)$ is obtained by removing from $\mathcal{I}_{JOINED}(k)$ the indices of such sources which have not been detected for a number of $K_{INACT}$ previous successive frames. The number $D_{ACT}(k)$ of active dominant sound sources at frame k is set to the number of elements of $\mathcal{I}_{DOM,ACT}(k)$. Finally, the dominant source direction estimates $\overline{\Omega}_{DOM,ACT}^{(i_{ACT,k}(d'))}(k)$, d'=1, . . . , $D_{ACT}(k)$, where $i_{ACT,k}(d')$ indicate the elements of $\mathcal{I}_{DOM,ACT}(k)$, are determined by $$\overline{\Omega}_{DOM,ACT}^{(i_{ACT,k}(d'))}(k)=\begin{cases}\hat{\Omega}_{DOM}^{(i_{ACT,k}(d'))}(k) & \text{if } i_{ACT,k}(d')\in\mathcal{I}_{NEW}(k)\\ \overline{\Omega}_{DOM,ACT}^{(i_{ACT,k}(d'))}(k-1) & \text{else}\end{cases}. \quad (38)$$

This means that the directions of previously active dominant sound sources are held fixed if the respective sound source is not newly detected at frame k.

Basics of Higher Order Ambisonics

Higher Order Ambisonics (HOA) is based on the description of a sound field within a compact area of interest, which is assumed to be free of sound sources. In that case the spatio-temporal behaviour of the sound pressure p(t,x) at time t and position x within the area of interest is physically fully determined by the homogeneous wave equation. In the following a spherical coordinate system as shown in FIG. 5 is assumed. In the used coordinate system the x axis points to the frontal position, the y axis points to the left, and the z axis points to the top. A position in space $x=(r,\theta,\phi)^T$ is represented by a radius r>0 (i.e. the distance to the coordinate origin), an inclination angle $\theta\in[0,\pi]$ measured from the polar axis z and an azimuth angle $\phi\in[0,2\pi[$ measured counter-clockwise in the x-y plane from the x axis. $(\bullet)^T$ denotes the transposition.

Then, it can be shown (cf. E. G. Williams, "Fourier Acoustics", vol. 93 of Applied Mathematical Sciences, Academic Press, 1999) that the Fourier transform of the sound pressure with respect to time denoted by $\mathcal{F}_t(\bullet)$, i.e.

$$P(\omega,x)=\mathcal{F}_t(p(t,x))=\int_{-\infty}^{\infty}p(t,x)e^{-i\omega t}dt \quad (39)$$

with ω denoting the angular frequency and i indicating the imaginary unit, can be expanded into a series of Spherical Harmonics according to $$P(\omega=kc_s,r,\theta,\phi)=\Sigma_{n=0}^{N}\Sigma_{m=-n}^{n}A_n^m(k)j_n(kr)S_n^m(\theta,\phi). \quad (40)$$

In equation (40), $c_s$ denotes the speed of sound and k denotes the angular wave number, which is related to the angular frequency ω by $$k=\frac{\omega}{c_s},\ j_n(\cdot)$$

denotes the spherical Bessel functions of the first kind and $S_n^m(\theta,\phi)$ denotes the real-valued Spherical Harmonics of order n and degree m, which are defined in below section Definition of real-valued Spherical Harmonics. The expansion coefficients $A_n^m(k)$ are depending only on the angular wave number k. It is implicitly assumed that the sound pressure is spatially band-limited. Thus the series is truncated with respect to the order index n at an upper limit N, which is called the order of the HOA representation.

If the sound field is represented by a superposition of an infinite number of harmonic plane waves of different angular frequencies ω arriving from all possible directions specified by the angle tuple (θ,φ), it can be shown (see B. Ra-faely, "Plane-wave Decomposition of the Sound Field on a Sphere by Spherical Convolution", J. Acoust. Soc. Am., vol. 4(116), pp. 2149-2157, 2004) that the respective plane wave complex amplitude function C(ω,θ,φ) can be expressed by the following Spherical Harmonics expansion:

$$C(\omega=kc_s,\theta,\phi)=\Sigma_{n=0}^{N}\Sigma_{m=-n}^{n}C_n^m(k)S_n^m(\theta,\phi), \quad (41)$$

where the expansion coefficients $C_n^m(k)$ are related to the expansion coefficients $$A_n^m(k) \text{ by } A_n^m(k)=4\pi i^n C_n^m(k). \tag{42}$$

When assuming that the individual coefficients $C_n^m(k=\omega/c_s)$ are functions of the angular frequency ω, the application of the inverse Fourier transform (denoted by $\mathcal{F}^{-1}(\bullet)$) provides time domain functions $$c_n^m(t) = \mathcal{F}_t^{-1}(C_n^m(\omega/c_s)) = \frac{1}{2\pi}\int_{-\infty}^{\infty} C_n^m\left(\frac{\omega}{c_s}\right)e^{i\omega t}\,d\omega \tag{43}$$

for each order n and degree m, which can be collected in a single vector $$c(t) \text{ by } c(t)=[c_0^0(t),c_1^{-1}(t),c_1^0(t),c_1^1(t),c_2^{-2}(t),c_2^{-1}(t),c_2^0(t),c_2^1(t),c_2^2(t), \ldots ,c_N^{N-1}(t),c_N^N(t)]^T.$$

The position index of a time domain function $c_n^m(t)$ within the vector c(t) is given by n(n+1)+1+m. The overall number of elements in the vector c(t) is given by $O=(N+1)^2$.

The final Ambisonics format provides the sampled version of c(t) using a sampling frequency $f_S$ as $$\{c(lT_S)\}_{l\in N}=\{c(T_S),c(2T_S),c(3T_S),c(4T_S), \ldots \} \tag{45}$$

where $T_S=1/f_S$ denotes the sampling period. The elements of $c(lT_S)$ are referred to as Ambisonics coefficients. The time domain signals $c_n^m(t)$ and hence the Ambisonics coefficients are real-valued.

Definition of Real-Valued Spherical Harmonics

The real-valued Spherical Harmonics $S_n^m(\theta,\phi)$ are expressed by $$S_n^m(\theta,\phi) = \sqrt{\frac{(2n+1)}{4\pi}\frac{(n-|m|)!}{(n+|m|)!}}\,P_{n,|m|}(\cos\theta)trg_m(\phi) \tag{46}$$

with $$trg_m(\phi) = \begin{cases} \sqrt{2}\cos(m\phi) & \text{for } m>0 \\ 1 & \text{for } m=0 \\ -\sqrt{2}\sin(m\phi) & \text{for } m<0 \end{cases}. \tag{47}$$

The associated Legendre functions $P_{n,m}(x)$ are defined as $$P_{n,m}(x) = (1-x^2)^{\frac{m}{2}}\frac{d^m}{dx^m}P_n(x), \quad m \geq 0 \tag{48}$$

with the Legendre polynomial $P_n(x)$ and, unlike in the above-mentioned E. G. Williams textbook, without the Condon-Shortley phase term $(-1)^m$.

Spatial Resolution of Higher Order Ambisonics

A general plane wave function x(t) arriving from a direction $\Omega_0=(\theta_0,\phi_0)^T$ is represented in HOA by $$c_n^m(t)=x(t)S_n^m(\Omega_0),\ 0\leq n\leq N,\ |m|\leq n. \tag{49}$$

The corresponding spatial density of plane wave amplitudes $$c(t,\Omega) := \mathcal{F}_t^{-1}(C(\omega,\Omega)) \text{ is given by}$$

-continued $$c(t,\Omega) = \sum_{n=0}^{N}\sum_{m=-n}^{n} c_n^m(t)S_n^m(\Omega) \tag{50}$$

$$= x(t)\underbrace{\left[\sum_{n=0}^{N}\sum_{m=-n}^{n} S_n^m(\Omega_0)S_n^m(\Omega)\right]}_{\nu_N(\Theta)}. \tag{51}$$

It can be seen from equation (51) that it is a product of the general plane wave function x(t) and a spatial dispersion function $\nu_N(\Theta)$, which can be shown as depending only on the angle Θ between Ω and $\Omega_0$ having the property $$\cos\Theta=\cos\theta\cos\theta_0+\cos(\phi-\phi_0)\sin\theta\sin\theta_0. \tag{52}$$

As expected, in the limit of an infinite order, i.e. $N\rightarrow\infty$, the spatial dispersion function turns into a Dirac delta δ(•), $$\text{i.e. } \lim_{N\rightarrow\infty}\nu_N(\Theta) = \frac{\delta(\Theta)}{2\pi}. \tag{53}$$

However, in the case of a finite order N, the contribution of the general plane wave from direction $\Omega_0$ is smeared to neighbouring directions, where the extent of the blurring decreases with an increasing order. A plot of the normalised function $\nu_N(\Theta)$ for different values of N is provided in FIG. 6.

For any direction Ω the time domain behaviour of the spatial density of plane wave amplitudes is a multiple of its behaviour at any other direction. In particular, the functions $c(t,\Omega_1)$ and $c(t,\Omega_2)$ for some fixed directions $\Omega_1$ and $\Omega_2$ are highly correlated with each other with respect to time t.

Spherical Harmonic Transform

If the spatial density of plane wave amplitudes is discretised at a number of O spatial directions $\Omega_o$, $1\leq o\leq O$, which are nearly uniformly distributed on the unit sphere, O directional signals $c(t,\Omega_o)$ are obtained. Collecting these signals into a vector as $$c_{SPAT}(t):=[c(t,\Omega_1) \ldots c(t,\Omega_O)]^T, \tag{54}$$

it can be verified by using equation (50) that this vector can be computed from the continuous Ambisonics representation d(t) defined in equation (44) by a simple matrix multiplication as $$c_{SPAT}(t)=\psi^H c(t), \tag{55}$$

where $(\bullet)^H$ indicates the joint transposition and conjugation, and ψ denotes a mode-matrix defined by $$\psi:=[S_1 \ldots S_O] \tag{56}$$

with $$S_O:=[S_0^0(\Omega_o)\ S_1^{-1}(\Omega_o)\ S_1^0(\Omega_o)\ S_1^1(\Omega_o) \ldots S_N^{N-1}(\Omega_o)\ S_N^N(\Omega_o)]. \tag{57}$$

Because the directions $\Omega_o$ are nearly uniformly distributed on the unit sphere, the mode matrix is invertible in general. Hence, the continuous Ambisonics representation can be computed from the directional signals $c(t,\Omega_o)$ by $$c(t)=\psi^{-H}c_{SPAT}(t). \tag{58}$$

Both equations constitute a transform and an inverse transform between the Ambisonics representation and the 'spatial domain'. These transforms are denoted the Spherical Harmonic Transform and the inverse Spherical Harmonic Transform, respectively. Because the directions $\Omega_o$ are nearly uniformly distributed on the unit sphere, there is the approximation $$\psi^H \approx \psi^{-1}, \tag{59}$$

which justifies the use of $\psi^{-1}$ instead of $\psi^H$ in equation (55). All mentioned relations are valid for the discrete-time domain, too.

The inventive processing can be carried out by a single processor or electronic circuit, or by several processors or electronic circuits operating in parallel and/or operating on different parts of the inventive processing.

The invention claimed is:

1. A method for determining directions of uncorrelated sound sources in a Higher Order Ambisonics (HOA) representation of a sound field, comprising:

in a current time frame of HOA coefficients, searching preliminary direction estimates of dominant sound sources; and determining HOA sound field components based on corresponding dominant sound sources, wherein a current direction estimate is determined based on a residual HOA representation which represents an original HOA representation from which all components correlated with signals of previously found sound sources have been removed, wherein the current direction estimate is selected out of a set of predefined test directions, based on a power of a related general plane wave of the residual HOA representation, impinging from a direction on a listener position, relative to respective power of all other test directions, and wherein the current direction estimate for the current time frame of HOA coefficients is assigned to at least a dominant sound source of a previous time frame of HOA coefficients and is smoothed with respect to a time trajectory.

2. The method of claim 1, wherein the smoothing is based on a Bayesian inference process that exploits a statistical a priori sound source movement model and directional power distributions of the dominant sound source components of the original HOA representation.

3. The method of claim 2, wherein the statistical a priori model statistically predicts a movement of individual sound sources based on their direction in the previous time frame and movement between the previous time frame and a penultimate time frame.

4. The method of claim 2, wherein direction estimates are assigned to dominant sound sources of the previous time frame of HOA coefficients based on a joint minimization of angles between pairs of a direction estimate and a direction of a previously found sound source, and maximization of an absolute value of a correlation coefficient between the pairs of the directional signals related to a direction estimate and to a dominant sound source found in the previous time frame of HOA coefficients.

5. A method for determining directions of uncorrelated sound sources in a Higher Order Ambisonics (HOA) representation of a sound field, comprising:

in a current time frame of HOA coefficients, searching preliminary direction estimates of dominant sound sources, and determining HOA sound field components based on corresponding dominant sound sources, and determining corresponding directional signals;

assigning the dominant sound sources to corresponding sound sources active in a previous time frame of the HOA coefficients based on a comparison of the preliminary direction estimates of the current time frame and smoothed directions of sound sources active in the previous time frame, wherein the assignment is further based on a correlation of directional signals of the current time frame and directional signals of sound sources active in the previous time frame, resulting in an assignment function;

determining smoothed dominant source directions based on the assignment function, the smoothed dominant source directions in the previous time frame, indices of active dominant sound sources in the previous time frame, respective source movement angles between the penultimate time frame and the previous time frame, and the HOA sound field components based on the corresponding dominant sound sources; and determining indices and directions of the active dominant sound sources of the current time frame based on the smoothed dominant source directions, a frame delayed version of directions of the active dominant sound sources of the previous time frame and a frame delayed version of indices of the active dominant sound sources of the previous time frame, wherein the directional signals of sound sources active in the previous time frame are determined based on mode matching based on the frame delayed version of directions of the active dominant sound sources of the previous time frame and the HOA coefficients of the previous time frame, and wherein the source movement angles between the penultimate time frame and the previous time frame is determined based on the frame delayed version of directions of the active dominant sound sources of the previous time frame and a further frame delayed version thereof.

6. An apparatus for determining directions of uncorrelated sound sources in a Higher Order Ambisonics (HOA) representation of a sound field, comprising:

a processor configured to search in a current time frame of HOA coefficients preliminary direction estimates of dominant sound sources, and to determine HOA sound field components based on corresponding dominant sound sources, the processor further configured to determine corresponding directional signals;

wherein the processor is further configured to assign the dominant sound sources to corresponding sound sources active in a previous time frame of the HOA coefficients based on a comparison of the preliminary direction estimates of the current time frame and smoothed directions of sound sources active in the previous time frame, wherein the assignment is further based on a correlation of the directional signals of the current time frame and directional signals of sound sources active in the previous time frame, resulting in an assignment function;

wherein the processor is further configured to determine smoothed dominant source directions based on the assignment function, the smoothed dominant source directions in the previous time frame, indices of active dominant sound sources in the previous time frame, respective source movement angles between the penultimate time frame and the previous time frame, and the HOA sound field components based on the corresponding dominant sound sources, wherein the processor is further configured to determine indices and directions of active dominant sound sources of the current time frame based on the smoothed dominant source directions, a frame delayed version of directions of the active dominant sound sources of the previous time frame and a frame delayed version of indices of the active dominant sound sources of the previous time frame, wherein the directional signals of sound sources active in the previous time frame are determined based on mode matching based on frame delayed version of directions of the active dominant sound sources of said previous time frame and the HOA coefficients of the previous time frame, and wherein the source movement angles between the penultimate time frame and the previous time frame is determined based on the frame delayed version of directions of the active dominant sound sources of the previous time frame and a further frame delayed version thereof.

7. The method of claim 5, wherein the determination of the detected dominant directional signals and the corresponding preliminary direction estimates, further includes:

determining an HOA sound field component based on a subtraction of the corresponding dominant sound sources from the current time frame of HOA coefficients in order to obtain a corresponding residual HOA representation, wherein the subtraction processing is repeatedly performed for each case of a remaining residual HOA representation for further sound field components, wherein the sound field components are excluded for further direction searches.

8. The method of claim 7, further comprising determining a representation for a predefined number of discrete test directions which are nearly uniformly distributed on a unit sphere, wherein directional power distribution is analyzed for presence of a dominant sound source, and based on a determination of an absence of a dominant sound source, the direction search is stopped and, based on a determination of a detection of a dominant source, a preliminary estimate of its direction with respect to a coordinate origin is determined.

9. The method of claim 8, wherein the respective directional signal and the HOA representation of the sound field components based on the same sound source are determined based on:

rotating a fixed predefined spherical grid consisting of sampling positions, wherein the sampling positions are targeted to be uniformly distributed on the unit sphere, to determine a grid of rotated sampling positions, wherein said rotation is performed such that a first rotated sampling position corresponds to the preliminary direction estimate;

transforming the remaining residual HOA representation to a spatial domain and determining dominant sound source signals and grid direction signals;

performing a prediction of the grid direction signals from the dominant sound source signals; and determining the HOA representation of the predicted grid directional signals, representing the contribution of the dominant sound source to the sound field represented by the remaining residual HOA representation, based on an inverse Spherical Harmonics Transform.

10. The method of claim 5, wherein the smoothed dominant source directions is are determined based on:

determining directional a priori probability functions for dominant sound source directions based on the assignment function, the smoothed dominant source directions in the previous time frame, the indices of active dominant sound sources in the previous time frame, and the source movement angles;

determining directional likelihood functions for dominant sound source directions based on the assignment function and the HOA sound field components created by dominant sound sources;

determining directional a posteriori probability functions for dominant sound source directions based on directional likelihood functions and the directional a priori probability functions;

determining smoothed dominant sound source directions based on the directional a posteriori probability functions for dominant sound source directions.

* * * * *